US007431313B1

(12) United States Patent
Torres et al.

(10) Patent No.: US 7,431,313 B1
(45) Date of Patent: Oct. 7, 2008

(54) PORTABLE TOOL STORAGE APPARATUS

(76) Inventors: Jose Torres, 788 Ashboro La., Galt, CA (US) 95632; Sonia Torres, 788 Ashboro La., Galt, CA (US) 95632

( * ) Notice: Subject to any disclaimer, the term of this patent is extended or adjusted under 35 U.S.C. 154(b) by 270 days.

(21) Appl. No.: 11/438,707

(22) Filed: May 23, 2006

(51) Int. Cl.
*A47F 7/00* (2006.01)

(52) U.S. Cl. ..... 280/47.26; 280/47.24; 280/47.17; 280/47.34; 280/63; 280/124.12; 280/137.501

(58) Field of Classification Search ..... 280/47.26, 280/79.2, 47.17, 63, 47.131, 47.24, 47.34, 280/124.12, 137.501; 224/576, 584; 206/349; 211/70.6
See application file for complete search history.

(56) References Cited

U.S. PATENT DOCUMENTS

| | | | | | |
|---|---|---|---|---|---|
| 4,993,551 | A * | 2/1991 | Lindsay | 206/373 |
| 5,333,885 | A | 8/1994 | Pullman | |
| 5,390,944 | A | 2/1995 | Sherwin | |
| 5,704,496 | A * | 1/1998 | Latta | 211/70.6 |
| 5,833,095 | A * | 11/1998 | Russell et al. | 224/576 |
| 6,138,827 | A * | 10/2000 | Marshall | 206/373 |
| 6,149,168 | A | 11/2000 | Pauser et al. | |
| 6,176,559 | B1 | 1/2001 | Tiramani et al. | |
| 6,536,590 | B1 * | 3/2003 | Godshaw et al. | 206/373 |
| 6,938,761 | B2 * | 9/2005 | Nish | 206/315.11 |
| 7,073,205 | B2 * | 7/2006 | Finn | 2/160 |
| 2006/0144732 | A1 * | 7/2006 | Kaplan et al. | 206/349 |

* cited by examiner

*Primary Examiner*—Christopher Ellis
*Assistant Examiner*—Cynthia F. Collado
(74) *Attorney, Agent, or Firm*—Crossley Patent Law; Mark Ashley Crossley

(57) ABSTRACT

A portable tool storage apparatus for use by individuals to have both tool storage capabilities and easy mobility to move tools to various locations as needed. The apparatus is fabricated from a circular bucket that has two concentric straps attached to the exterior surface of the bucket. Each of the straps has several pouches attached to it, with the pouches designed to store tools, nails, fasteners, or related objects. An organizer tray attached to the bucket for storing screws and bolts and similar items is also provided. The apparatus also has an axle located on the bottom surface of the bucket and a pair of wheels attached to the axle. A telescoping handle is attached to the apparatus, allowing an individual to easily move the apparatus from location to location.

1 Claim, 4 Drawing Sheets

PORTABLE TOOL STORAGE APPARATUS

BACKGROUND OF THE INVENTION

The present invention concerns that of a new and improved portable tool storage apparatus for use by individuals to have both tool storage capabilities and easy mobility to move tools to various locations as needed.

DESCRIPTION OF THE PRIOR ART

U.S. Pat. No. 6,176,559 B1, issued on Jan. 23, 2001 to Tiramani et al., discloses a rolling containers assembly which includes a base cabinet including wheels and a pulling handle for locomoting the rolling containers assembly.

U.S. Pat. No. 5,704,496, issued on Jan. 6, 1998 to Latta, discloses a modular system of racks for mounting on a wheeled container to convert the wheeled container into a tool-bearing yard and garden cart.

U.S. Pat. No. 5,390,944, issued on Feb. 21, 1995 to Sherwin, discloses an implement carrier and organizer.

U.S. Pat. No. 5,333,885, issued on Aug. 2, 1994 to Pullman, discloses a wheeled cart having a floor including an intermediate shelf and an uppermost shelf.

U.S. Pat. No. 6,149,168, issued on Nov. 21, 2000 to Pauser et al., discloses a carrier for tools and the like which has a base normally adapted to sit on a floor surface.

SUMMARY OF THE INVENTION

The present invention concerns that of a new and improved portable tool storage apparatus for use by individuals to have both tool storage capabilities and easy mobility to move tools to various locations as needed. The apparatus is fabricated from a circular bucket that has two concentric straps attached to the exterior surface of the bucket. Each of the straps has several pouches attached to it, with the pouches designed to store tools, nails, fasteners, or related objects. The apparatus also has an axle located on the bottom surface of the bucket and a pair of wheels attached to the axle. A telescoping handle is attached to the apparatus, allowing an individual to easily move the apparatus from location to location.

There has thus been outlined, rather broadly, the more important features of a portable tool storage apparatus that the detailed description thereof that follows may be better understood and in order that the present contribution to the art may be better appreciated. There are, of course, additional features of the portable tool storage apparatus that will be described hereinafter and which will form the subject matter of the claims appended hereto.

In this respect, before explaining at least one embodiment of the portable tool storage apparatus in detail, it is to be understood that the portable tool storage apparatus is not limited in its application to the details of construction and to the arrangements of the components set forth in the following description or illustrated in the drawings. The portable tool storage apparatus is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present portable tool storage apparatus. It is important, therefore, that the claims be regarded as including such equivalent constructions insofar as they do not depart from the spirit and scope of the present invention.

It is therefore an object of the present invention to provide a portable tool storage apparatus which has all of the advantages of the prior art and none of the disadvantages.

It is another object of the present invention to provide a portable tool storage apparatus which may be easily and efficiently manufactured and marketed.

It is another object of the present invention to provide a portable tool storage apparatus which is of durable and reliable construction.

It is yet another object of the present invention to provide a portable tool storage apparatus which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
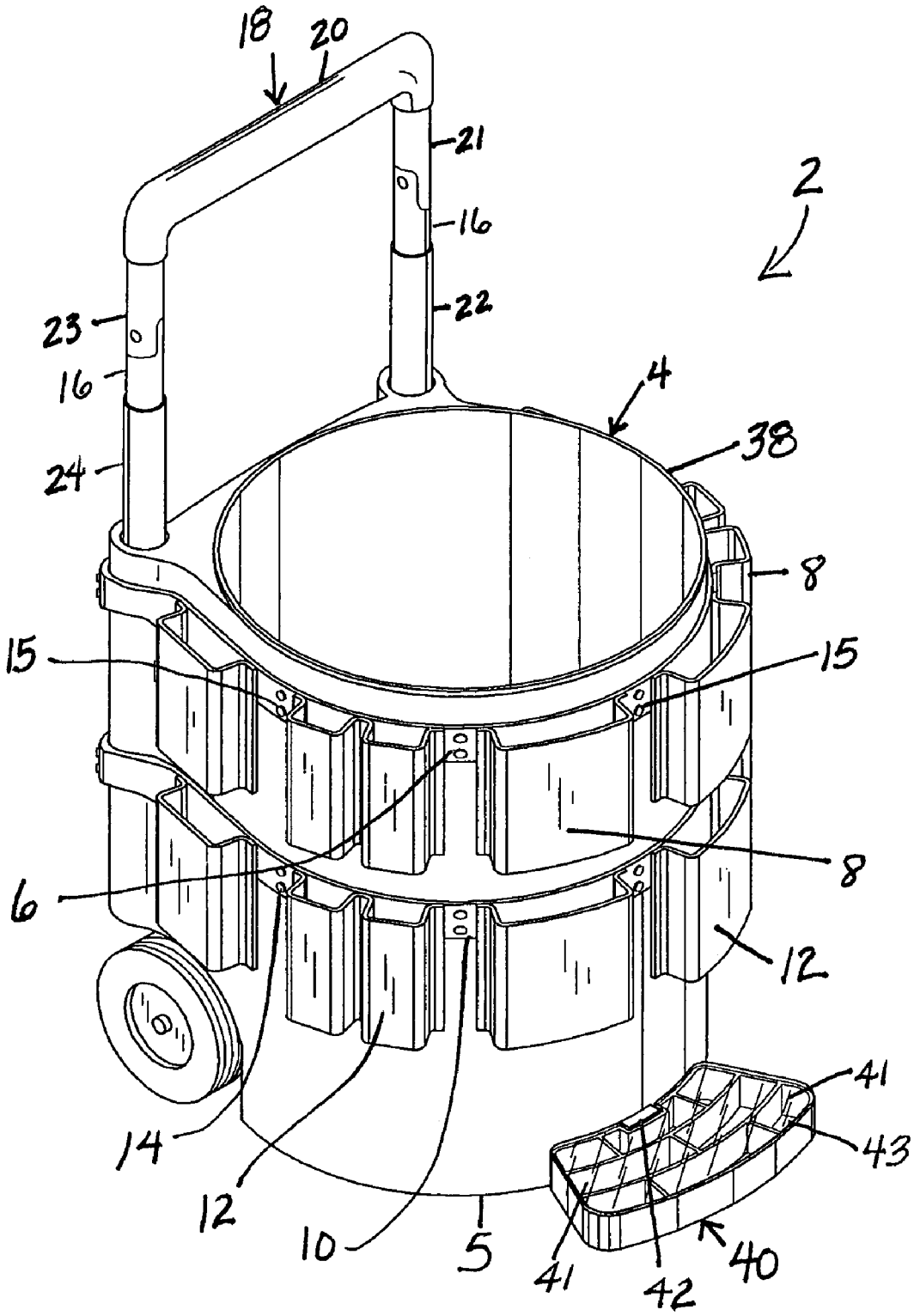
FIG. 1 shows a front perspective view of the portable tool storage apparatus.
Figure 2:
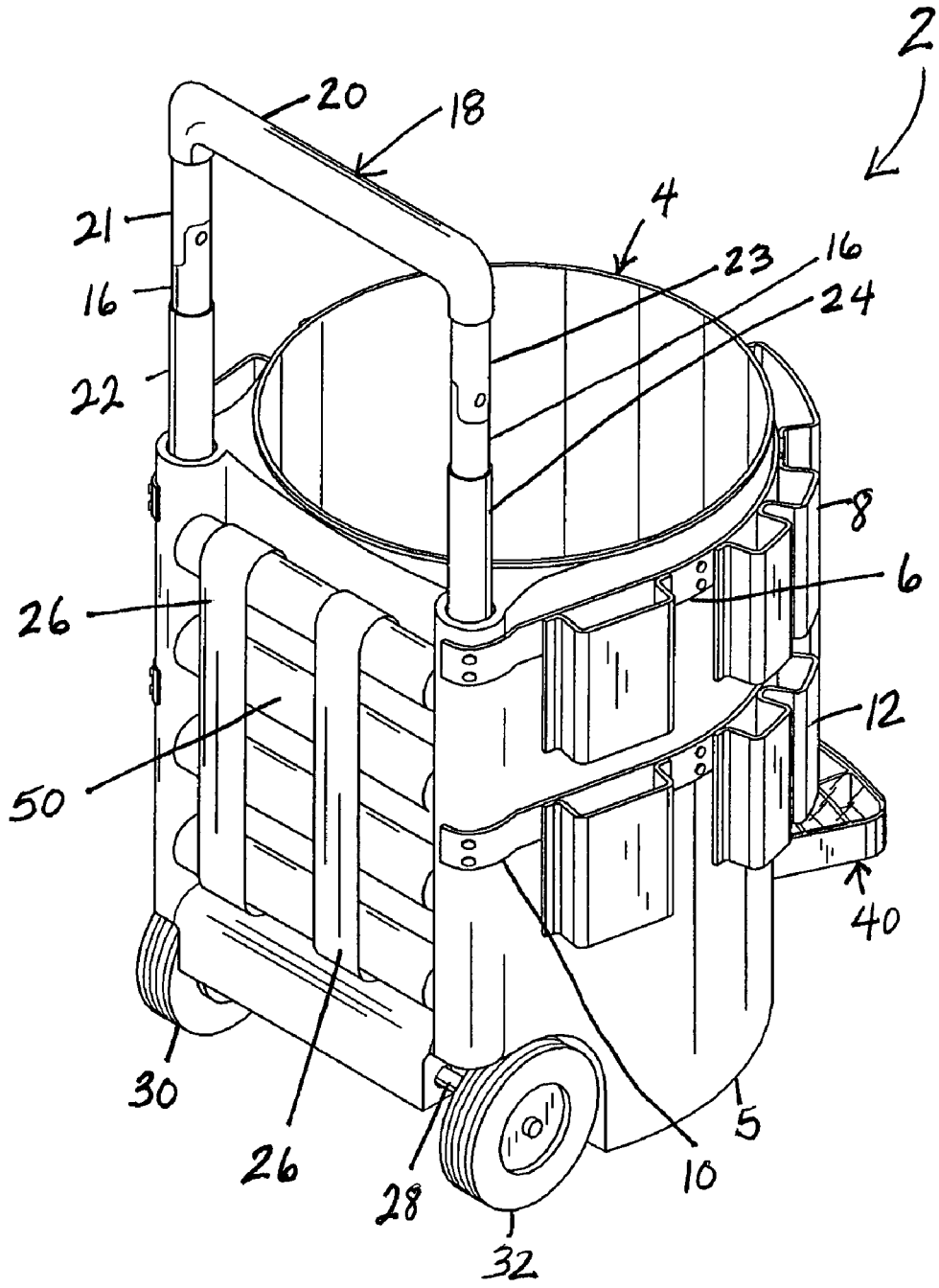
FIG. 2 shows a rear perspective view of the portable tool storage apparatus.
Figure 3:
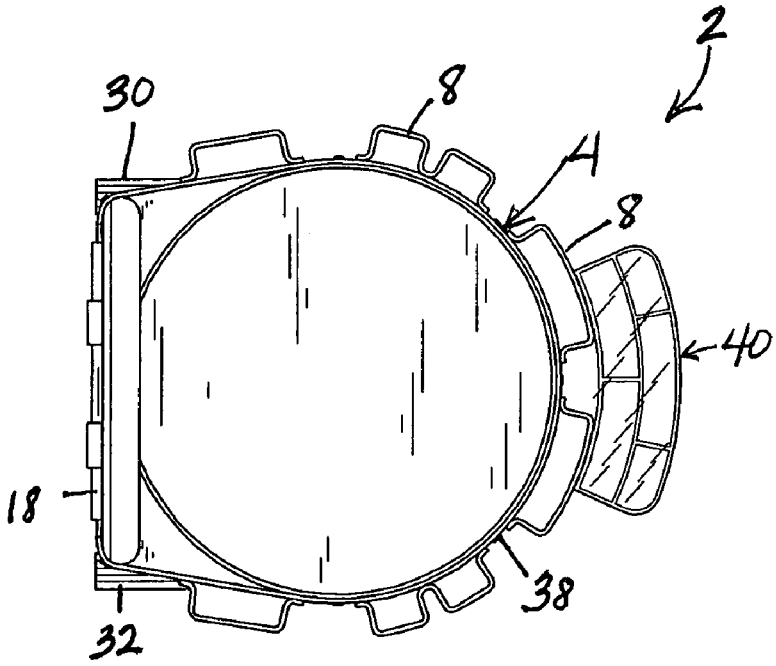
FIG. 3 shows a top view of the portable tool storage apparatus.
Figure 4:
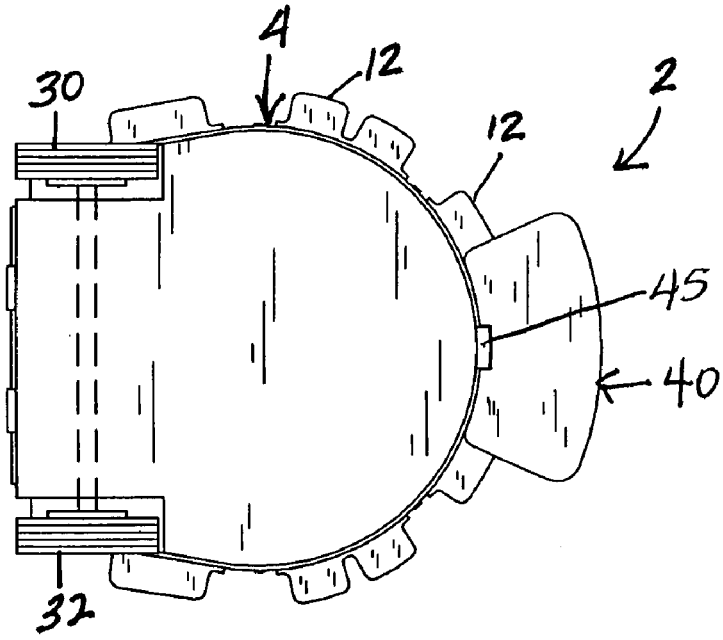
FIG. 4 shows a bottom view of the portable tool storage apparatus.

With reference now to the drawings, and in particular to FIGS. 1 through 5 thereof, a new portable tool storage apparatus embodying the principles and concepts of the present invention and generally designated by the reference numeral 2 will be described.

As best illustrated in FIGS. 1 through 5, a portable tool storage apparatus 2 comprises a bucket 4 that has a bottom surface 5, with the bottom surface 5 of the bucket 4 having an interior surface and an exterior surface. The bucket 4 is preferably circular in nature and has an interior surface and an exterior surface.

Apparatus 2 further comprises a pair of straps, an upper strap 6 and a lower strap 10, which are attached concentrically around the exterior surface of the bucket 4. The upper strap 6 is preferably located further away from the bottom surface 5 of the bucket 4 than the lower strap 10 is located. Each of the straps are attached to the bucket 4 utilizing mounting means 14, with the mounting means 14 preferably comprising a plurality of rivets 15.

A plurality of upper pouches 8 are attached to the upper strap 6, while a plurality of lower pouches 12 are attached to the lower strap 10. Each plurality of pouches has pouches of varying sizes and is designed for storage of various objects, tools, fasteners, and other related objects as needed.

Connected near the front of and bottom surface 5 of said bucket 4 is a three-dimensional generally rectilinear organizer tray 40 formed so as to allow it to follow the outside shape of said bucket 4. A connector piece 45 attaches said organizer tray 40 to said bucket 4. Said connector piece 45 is generally a ball in a socket hinge which allows said organizer tray 40 to rotate upwardly to fold in toward said bucket 4. Said organizer tray 40 is comprised of a plurality of compartments 41. Bolts, screws, nails, and the like may be stored in said compartments 41. Said organizer tray 40 has a lid 43 of the same general shape as said organizer tray 40. A clasp 42 is provided to open and close said lid 43 to prevent spilling of items stored within said organizer tray 40. Said organizer tray 40 may be formed of hard plastic material, metal or other appropriate materials. Said lid 43 may be formed of transparent plastic material or other materials which prevent spilling of items stored within said organizer tray 40.

Attached to the exterior surface of the bottom surface 5 of the bucket 4 is an axle 28, with the axle having two wheels, a left wheel 30 and a right wheel 32. The pair of wheels 30 and 32 are essentially embedded within the exterior surface of the bottom surface 5 of the bucket 4, with the bottom of the wheels 30 and 32 being flush with a ground surface. The wheels can be any one of a number of sizes, but preferably have a diameter of four inches. When the apparatus 2 is not being used, the apparatus 2 will rest on the exterior surface of the bottom surface 5 of the bucket 4.

The apparatus 2 further comprises a telescoping handle 18. Telescoping handle 18 comprises a pair of stands comprising a left stand 22 and a right stand 24, a pair of inner portions comprising a left inner portion 21 and a right inner portion 23, a pair of pivot points 16, and a handle 20. The left stand 22 and the right stand 24 are attached to the exterior surface of the bucket 4 in vertical fashion and are parallel to one another. The left inner portion 21 is located within the left stand 22 and is telescoping within the left inner portion 21, while the right inner portion 23 is located within the right stand 24 and is telescoping within the right inner portion 23.

Handle 20 is a U-shaped handle and is attached to the left inner portion 21 and the right inner portion 23. The U-shaped handle is normally kept planar with the left inner portion 21 and the right inner portion 23, but can be adjusted as needed to one of several various positions that are not planar through the use of hinges 16 on the left inner portion 21 and the right inner portion 23 to provide additional portability to the apparatus 2.

Figure 5:
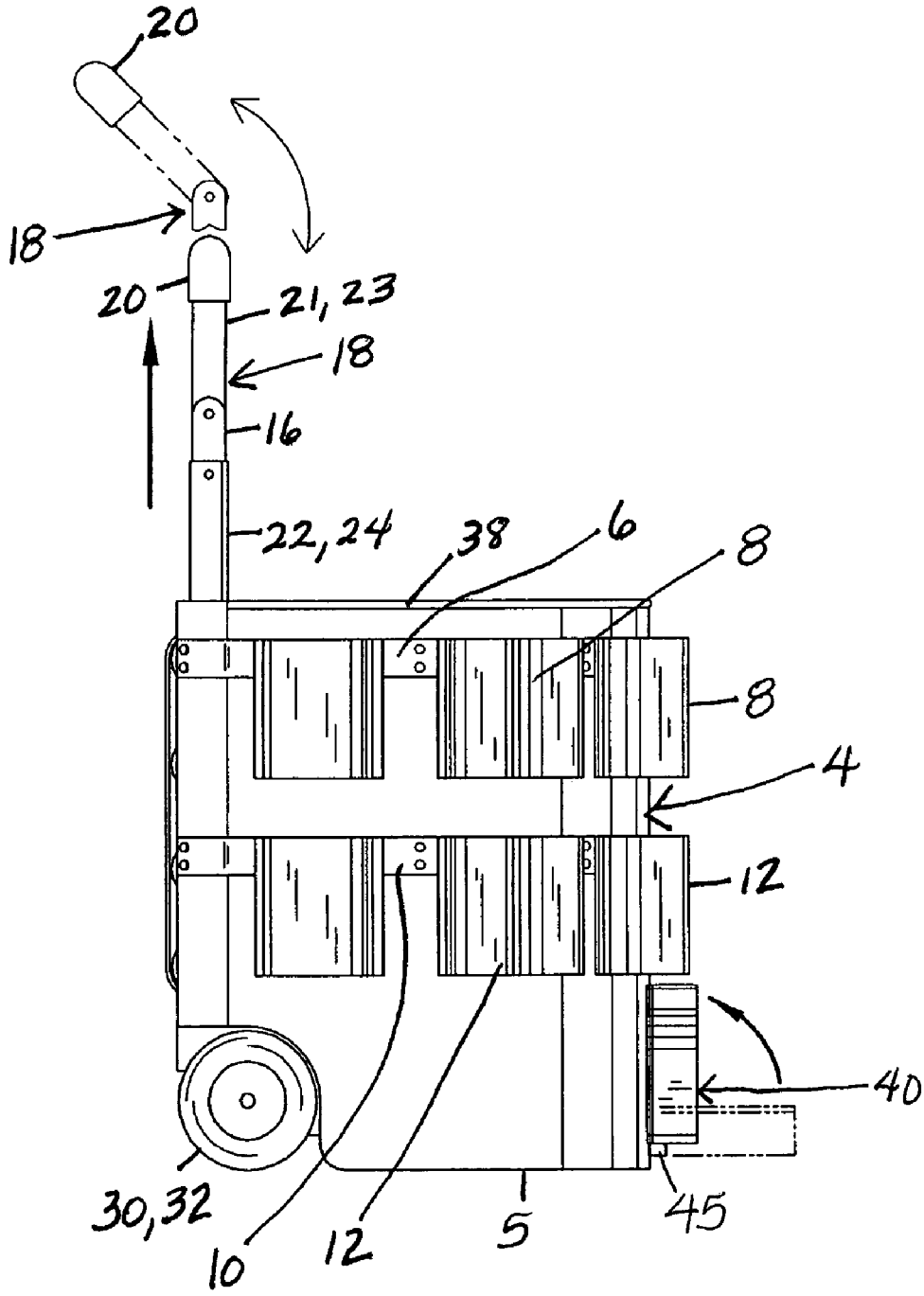
FIG. 5 shows a side view of the portable tool storage apparatus.

Both the left inner portion 21 and the right inner portion 23 have a hinge 16 which allows these portions of the handle telescoping handle 18 to pivot as needed. FIG. 5 shows an example of how the telescoping handle 18, as a whole, can extend straight outwards, or in the alternative, can be bent slightly to facilitate easier transport of the apparatus 2.

The apparatus 2 has a plurality of back straps 26 that are mounted on a plurality of rollers 50. Each of the rollers 50 has two ends, a left end and a right end, with the left end of each roller 50 being attached to the left stand and the right end of each roller 50 being attached to the right stand. These back straps 26 act as rolling bands and make it easier to facilitate transport of the apparatus 2 when it is going up and down stairs.

The apparatus 2 further comprises a cover lid ring 38 that is located on the top of the bucket 4. The cover lid ring 38 allows placement of a cover when the apparatus 2 is not in use or when transporting a large volume of items within the actual bucket 4 of the apparatus 2. The cover lid ring 38 will provide a temporary seal once a cover is placed on top of the bucket 4, also allowing the cover to be easily removed when desired.

In use, an individual would load the bucket 4 and/or one or more pouches 8 and 12 with tools, fasteners, and the like. Then, the individual would extend the telescoping handle 18 and grasp the handle 20. By then tilting the telescoping handle 18 toward an individual, the exterior surface of the bottom surface 5 of the bucket 4 will be forced off of the ground surface, with the bucket 4 will be resting on top of the pair of wheels 30 and 32. Then, apparatus 2 can be easily transported around as needed by pulling the handle 20 when an individual is transporting around.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable tool storage apparatus comprising:

(a) a bucket, the bucket including a bottom surface, the bottom surface including an interior surface and an exterior surface, the bucket being circular, the bucket having an exterior surface and an interior surface, (b) a plurality of pockets attached to the exterior surface of the bucket, (c) an organizer tray attached to the exterior surface of said bucket, (d) a locomotion device attached to the bucket, wherein the locomotion device attached to the bucket further comprises:

an axle attached to the exterior surface of the bottom surface of the bucket, and a pair of wheels comprising a left wheel and a right wheel, the pair of wheels being attached to the axle, wherein each of the wheels preferably has a diameter of four (4) inches, (e) a telescoping handle attached to the bucket, wherein the telescoping handle attached to the bucket further comprises:

a handle, the handle preferably being U-shaped, a pair of inner portions comprising a left inner portion and a right inner portion, the left inner portion and the right inner portion each being attached to the handle, a pair of stands comprising a left stand and a right stand, wherein the left stand and the right stand are each attached to the exterior surface of the bucket, wherein the left inner portion is telescoping within the left stand, and further wherein the right inner portion is telescoping within the right stand, means for pivoting the left inner portion and the right inner portion as needed, the means for pivoting comprising:

a pair of hinges comprising a first hinge and a second hinge, wherein the first hinge is located on the left inner portion, and further wherein the second hinge is located on the right inner portion, (f) an upper strap attached concentrically around the exterior surface of the bucket, (g) a plurality of upper pouches attached to the upper strap, (h) a lower strap attached concentrically around the exterior surface of the bucket, (i) a plurality of lower pouches attached to the lower strap, (j) wherein each plurality of pouches has pouches of varying sizes, (k) mounting means for attaching the upper strap and the lower strap to the exterior surface of the bucket, (l) wherein the upper strap is located farther away from the bottom surface of the bucket than the lower strap is located, (m) a plurality of rollers, each roller having two ends, a left end and a right end, the left end of each roller being attached to the left stand, the right end of each roller being attached to the right stand, (n) a pair of back strips, wherein each of the back strips is mounted on each roller of the plurality of rollers, and (o) a cover lid ring, the cover lid ring being located on the top of the bucket.

* * * * *